United States Patent [19]

Arnold et al.

[11] Patent Number: 4,610,429

[45] Date of Patent: Sep. 9, 1986

[54] PLUMBING CONNECTION

[75] Inventors: Don C. Arnold, Buffalo Grove, Ill.; Thomas J. Wilcox, East Troy, Wis.

[73] Assignee: Sajar Plastics, Inc., Middlefield, Ohio

[21] Appl. No.: 794,320

[22] Filed: Nov. 1, 1985

Related U.S. Application Data

[63] Continuation of Ser. No. 488,097, Apr. 25, 1983, abandoned.

[51] Int. Cl.[4] ..... F16K 51/00

[52] U.S. Cl. ..... 251/148; 137/625.41; 137/636.4; 285/113; 285/331

[58] Field of Search ..... 137/625.17, 625.41, 137/636.4, 798, 801; 251/148, 151; 285/356, 331, 99, 108, 113, 332, 339

[56] References Cited

U.S. PATENT DOCUMENTS

| | | | |
|---|---|---|---|
| 2,399,275 | 4/1946 | Wenk | 285/356 X |
| 2,420,778 | 5/1947 | Herold | 285/113 X |
| 2,709,566 | 5/1955 | Davis | 251/148 |
| 2,993,677 | 7/1961 | Ford | 251/148 |
| 3,338,597 | 8/1967 | Mason . | |
| 3,381,978 | 5/1968 | Faustini . | |
| 3,381,982 | 5/1968 | Elek . | |
| 3,601,852 | 8/1971 | Bjahne . | |
| 3,687,492 | 8/1972 | Leopold et al. . | |
| 3,738,389 | 6/1973 | Cole et al. . | |
| 3,831,983 | 8/1974 | Stickler . | |
| 4,074,703 | 2/1978 | Smith | 285/356 X |
| 4,088,350 | 5/1978 | Lee, II | 285/356 X |

FOREIGN PATENT DOCUMENTS

| | | | |
|---|---|---|---|
| 2148965 | 4/1973 | Fed. Rep. of Germany | 285/332 |
| 1370139 | 7/1964 | France . | |

OTHER PUBLICATIONS

"Polybutylene: New Generation Plastic Piping Material"; Pipeline and Gas Journal, 8/1971, Dean Hale, ed.

*Primary Examiner*—A. Michael Chambers
*Assistant Examiner*—John C. Fox
*Attorney, Agent, or Firm*—Watts, Hoffmann, Fisher & Heinke

[57] ABSTRACT

A plumbing connection is disclosed to connect a supply conduit to a faucet. A supply conduit has a main cylindrical body portion with an expanded, end portion. The supply conduit is received in a valve mounting body having a commensurate throughbore and counterbore which are adapted to respectively engage in slidable contact the cylindrical main body portion of the supply conduit and the expanded end portion of the supply conduit. A resilient seal member with projections having throughbores is received in wedged contact within the expanded end portion of the supply conduit. A valve is removably secured to the valve mounting body and in contact with and in communication with the throughbores of the supply conduit and the seal member.

5 Claims, 3 Drawing Figures

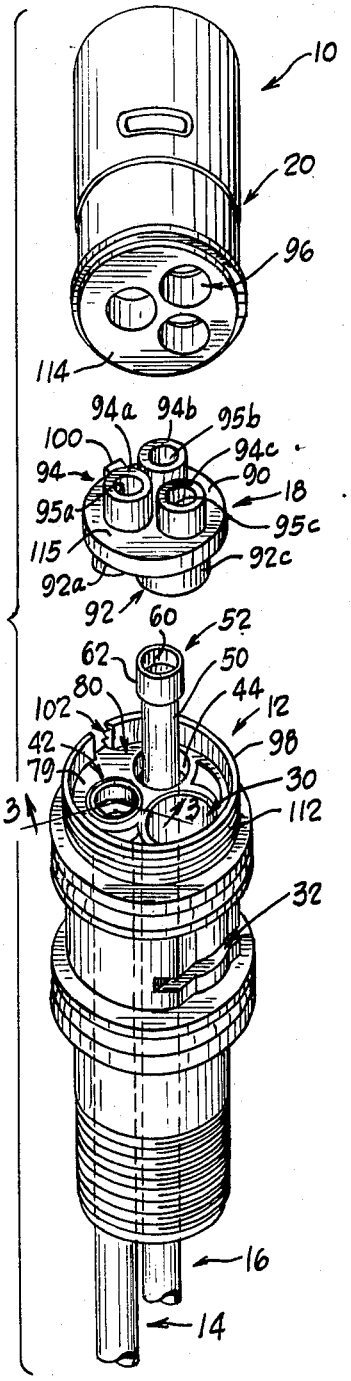
Fig. 1
Fig. 2
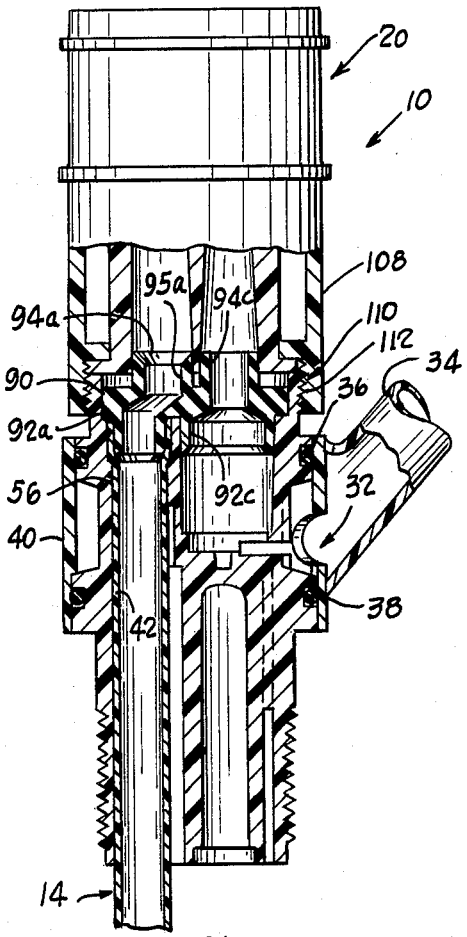
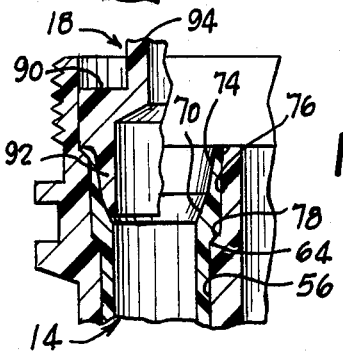
Fig. 3

PLUMBING CONNECTION

This application is a continuation of application Ser. No. 488,097, filed 4/25/83 now abandoned.

TECHNICAL FIELD

This invention relates to an improved plumbing connection and is particularly directed to effecting a a mechanical connection and a fluid tight seal between a supply conduit and a valve, such as a faucet.

BACKGROUND ART

Numerous plumbing connections between supply conduits and valves or faucets are known in the art. To provide a good fluid tight seal, various washers, adhesives, or other materials are generally required in fitting or coupling the supply conduit to the faucet.

One type of connection between a metal tubular water supply and a faucet body requires brazing or welding along with the use of a transitional member, such as rubber, to accomplish sealing and mechanical attachment. Metal parts, brazing, and assembly are becoming increasingly costly. Also, high temperatures utilized in the brazing process badly discolors the metals involved and usually makes it necessary to subsequently clean the parts with acid or alkaline.

When connecting metallic supply lines to a faucet with a plastic mounting body, sealing and mechanical attachment becomes complex in the sense that copper tubes cannot be brazed to plastic. In such cases copper tubes are brazed to a plate of brass, which in turn is screwed to the plastic mounting body of the faucet using a secondary gasket to provide a seal.

A particular problem is encountered in making a plumbing connection when the supply conduits are made from thin, flexible plastic tubing which are easily deformable and in addition, possess a rather low coefficient of friction. To assure a good mechanical connection, some prior designs have suggested the use of metallic fittings which use a rubber gasket seal against the outside plastic pipe diameter and an internal metal stiffener.

DISCLOSURE OF THE INVENTION

This invention provides a new and improved plumbing connection adapted for use between a supply conduit and a valve such as a faucet. The new plumbing connection in accordance with the present invention is designed to provide a mechanical connection and a fluid tight seal between a supply conduit and a faucet without the use of various washers, adhesives, brazing, welding or other materials.

In the preferred embodiment, the plumbing connection includes a supply conduit having an expanded end portion, a valve mounting body having a throughbore to receive the supply conduit, the throughbore having a counterbore at an end thereof and adapted to receive the expanded end portion of the supply conduit. A seal member is provided having a projection with a throughbore, the projection received in the expanded end portion of the supply conduit in sealing engagement. A valve is removably connected to the mounting body and in sealing contact with the seal member and in communication with the throughbore of the seal member.

Another feature of the present invention is a provision that the valve mounting body slidably engages a cylindrical outside surface of the expanded end portion of the supply conduit thus reducing or eliminating mechanical stresses at the terminal portion of the supply conduit caused by bending forces encountered by the supply conduit externally of the valve mounting body.

Another feature of the present invention is a provision for the interior surface of the expanded end portion of the supply conduit to be at least partially conical to provide a wedge fit between the seal member projection and the expanded portion of the supply conduit.

Still another feature of the present invention is a provision that the portion of the seal member received in the expanded end portion is made of an expandible elastomeric material, so that fluid pressure within the throughbore of the projection causes the projection to radially expand and exert further pressure against the interior of the expanded end portion of the supply conduit. The radial expansion of the projection further enhances a fluid tight seal.

Still yet another feature of the present invention is a provision that the expanded portion of the supply conduit is received in a counterbore of the throughbore of the valve mounting body and that the seal member, in combination with the valve removably secured to the valve mounting body, fixes the spatial relationship between the valve mounting body and the supply conduit to provide a good mechanical connection.

Other features and advantages and a fuller understanding of the invention will be had from the following detailed description and the accompanying drawings.

BRIEF DESCRIPTION OF THE DRAWINGS

FIG. 1 is an exploded view of a faucet assembly incorporating the present invention;

FIG. 2 is a side elevational view in partial section of a faucet assembly incorporating the present invention; and FIG. 3 is an enlarged side elevational view of a portion of a faucet assembly of FIG. 2.

BEST MODE FOR CARRYING OUT THE INVENTION

Referring now to the Figures, a plumbing connection to provide a mechanical connection and a fluid tight seal between a supply conduit and a valve of faucet assembly 10, is shown. For explanation purposes only, a double supply line with a single actuator valve and faucet assembly is shown. It will be appreciated that the invention is applicable to a single supply line and actuation valve as well.

A valve mounting body 12 receives two supply conduits 14, 16, a sealing member 18 and a valve 20. The operation of a double supply line with a single actuator valve or faucet is fully described in U.S. Pat. No. 3,738,389 to Cole et al and is hereby fully incorporated herein by reference. Therefore, the operation of this type of faucet will not be described in detail herein.

In the faucet 10, hot and cold water enter the faucet through the supply conduits 14, 16. The valve 20 controls the flow volume and the mixture between the hot and cold water that is being dispensed. The water exits the valve 20 and enters an exit port 30 of the valve mounting body where it further mixes prior to exiting through slot 32 and the faucet stem 34. Annular gaskets 36, 38 seal the cylindrical coupling 40 of the faucet stem 34 to the valve mounting body 12 in a known manner.

The valve mounting body 12 has through ports 42, 44. Each of the supply conduits 14, 16 and the throughbores 42, 44 are identical in structure. As best shown in connection with the conduit 16, the supply conduits have a substantially uniform main cylindrical section 50 of substantially uniform wall thickness and an expanded terminal end portion 52. Each port 42, 44 of the valve mounting body 12 has a narrow, substantially uniform cylindrical portion 56 (FIG. 3) which slidably engages the uniform portion 50 of its associated supply conduit.

The expanded end portion 52 of each supply conduit has an expanded inner wall surface 60 and an expanded outer wall surface 62. The outer wall 60 is substantially cylindrical with a larger diameter than the diameter of the main body portion 50. A slightly tapered shoulder 64 is provided between the expanded outer surface 62 and the main body portion 50. The inner wall surface 60 has two conical surfaces 70, 74 of different gradients 70, 74. The gradient of the surface 74, at the opening to the expanded end 52, is quite gradual while the gradient of the surface 70, adjacent the cylindrical body portion 50, is steep and is spaced axially from the shoulder 74 a distance greater than the wall thickness of the portion 50.

Each port 42, 44 of the valve mounting body 12 has a counterbore 76 forming a shoulder 78 with the smaller diameter portion 56. Each counterbore 76 is adapted to receive the expanded end portion 52 of a supply conduit. The cylindrical outer wall 62 of each supply conduit slidably engages the respective counterbore 76. The shoulder 64 of each supply conduit engages the respective shoulder 78 of the counterbore thus providing a seating arrangement therebetween. When a supply conduit is in position, the end of each supply conduit is flush with a plane surface 79 of a recess 80 of the valve mounting body 12. The conduits 14, 16 are not sealed in fluid-tight relationship within the ports of the body 12.

The engagement and seating arrangement of the conduits provides rigidity to the expanded end portions 52 and the main body portions 50 of the supply conduits respectively received in the counterbore and the throughbore portions of the ports, isolating the expanded ends of the supply conduits from any bending movement experienced by the supply conduits externally of the valve mounting body.

A seal member 18 has a circular disc portion 90 with three cylindrical lower projections 92, two of which are shown at 92*a*, 92*c* in FIG. 1 (the other of which will be referred to as 92*b*, although not shown, and corresponds in construction and function to 92*a*), and three cylindrical upper projections 94*a,b,c*. Each projection 92 has a bore that communicates with a bore of a projection 94 on the opposite side of the disc portion 90. There are, therefore, three throughbores 95*a,b,c*, two of which 95*a,b* pass separate flows of supply fluid and one of which 95*c* passes mixed fluid to the stem or spout 34. The upper projections 94 are received in slightly tapered ports 96 of the valve 20 and form a seal therebetween.

The disc portion 90 is received in the recess 80 defined by a wall projection 98. A key 100 radially projects from the disc 90 and is received in a key slot 102 of the wall projection 98. Two of the lower projections 92 are received, one each, in the expanded end portions 52 of the supply conduits 14, 16. The third lower projection 92*c* is received in the exit port 30 in sealing contact.

The lower projections 92 have a sufficient outer diameter to engage the inner conical wall surfaces 70, 74 of the expanded end portion 52 of the associated supply conduit. The seal member 18 is preferably made of an elastomeric material and the upper and lower projections are integral with the main disc portion 90. The conical surfaces 70, 74 provide a fluid tight wedge fit between the projections 92*a,b* and the expanded end portion 52 of the associated supply conduit. Because the seal member is made of an elastomeric material, fluid pressure in the supply conduits and in turn in the throughbores 95*a,b* causes the projections 92 to expand radially outward thus enhancing the fluid seal between the projections and the supply conduits.

A coupling 108 having a thread 110 is screwed onto a thread 112 of the valve mounting body 12. The lower end 114 of the valve 20 exerts pressure against an opposing surface 115 of the disc 90 thus causing the lower projections of the disc 90 to exert pressure within the expanded end portion of the supply conduits thus retaining the supply conduits in a seated position. When the valve 20 is secured to the valve mounting body 12, the arrangement of elements not only provides a novel mechanical connection but also a novel, fluid tight connection between the supply conduits and the valve or faucet.

The supply conduit can be made from either metal, such as copper, or from a plastic material such as polybutylene. The latter has the advantage of being relatively easy to form and low in cost.

Modifications and variations of the invention will be apparent to those skilled in the art in view of the foregoing detailed disclosure. Therefore, it is to be understood that, within the scope of the appended claims, the invention can be practiced otherwise than as specifically shown and described.

We claim:

1. A plumbing fixture comprising:

a plastic supply conduit having a main body portion with a substantially uniform wall thickness and having an expanded end portion with inner and outer wall portions of larger diameter than the main body portion, said inner wall portion being partially canted relative to said outer wall portion to define a cylindrical end portion ending in a tapered channel, said tapered channel having a narrow portion in propinquity with the main body portion, and a shoulder portion connecting the main body portion with the expanded end portion, said shoulder portion defining an outer shoulder between the main body portion and the expanded end portion;

a valve mounting body having a throughbore adapted to slidably engage said uniform outer diameter of said supply conduit, a smooth counterbore adapted to slidably receive said expanded end portion of said supply conduit, and a first coupling surface remote from the counterbore, said counterbore defining a seat wherein said outer shoulder of the supply conduit nestingly engages with said seat and wherein said outer wall portion of the expanded end confrontingly engages a wall portion of said counterbore;

a deformable elastomeric sealing member including a cylindrical tubular portion received in the cylindrical end portion and in sealing contact with the inner wall portion of said expanded end portion of said supply conduit, said inner wall portion compressing the tubular portion of the sealing member to form a wedge fit therewith; and a valve having a second coupling surface cooperatively coupleable with said first coupling surface of said valve mounting body, said valve in communication with the throughbore of said seal member and applying pressure against said seal member to hold said tubular portion thereof in sealing engagement with said inner wall portion.

2. The plumbing fixture of claim 1 wherein said taper is elongated sufficiently to provide a circumferential seal of substantial axial length between the tubular portion of the sealing member and the inner wall portion of the extended end.

3. The plumbing fixture of claim 1 wherein the distance between said inner and outer wall portions of the expanded end is longitudinally non-uniform.

4. The plumbing fixture of claim 1 wherein the length of the outer wall portion of the expanded end is about equal to the depth of the counterbore of the valve mounting body.

5. A plumbing fixture comprising:

a supply conduit having a main body portion of substantially uniform wall thickness, said supply conduit having an expanded end portion integral with said main body portion, said expanded end portion defining a shoulder portion and having a cylindrical portion with a partially tapered inner wall;

a valve mounting body having a throughbore and a smooth counterbore defining a shoulder stop to slidably receive in a seated position the shoulder portion of said expanded end portion of said supply conduit;

a resilient seal member having a main disc portion with first and second opposed cylindrical tubular portions integral therewith, and in communication with each other, said first tubular portion received in the expanded end portion of said supply conduit, each of said tubular portions being made of a sufficiently resilient material so that said tapered inner wall portion causes the cylindrical tubular portion received therein to contract radially inward and so that fluid pressure within the received tubular portion causes it to expand radially outward thereby forming a circumferential seal; and a valve having a threaded collar, said valve being removably secured to said valve body by said threaded collar, said valve having an input port to receive said second opposed tubular portion of said seal member, said valve constructed and arranged to apply pressure against said seal member to retain said supply conduit in a fully seated position.

* * * * *